United States Patent [19]

Kilian

[11] Patent Number: 4,779,733

[45] Date of Patent: Oct. 25, 1988

[54] DISPLAY TAB FOR OVERWRAPPED PACKAGE

[75] Inventor: Waldemar R. J. Kilian, Jersey City, N.J.

[73] Assignee: The American Tobacco Company, Stamford, Conn.

[21] Appl. No.: 143,781

[22] Filed: Jan. 14, 1988

Related U.S. Application Data

[63] Continuation of Ser. No. 56,207, Jun. 1, 1987, abandoned.

[51] Int. Cl.[4] ..... G09F 3/00

[52] U.S. Cl. ..... 206/459; 40/312; 40/594; 206/606; 206/831; 229/87 C

[58] Field of Search ..... 229/87 C; 206/606, 459, 206/627, 831, 264, 45.33; 40/307, 312, 311, 313, 594

[56] References Cited

U.S. PATENT DOCUMENTS

| | | | |
|---|---|---|---|
| 2,042,813 | 6/1936 | Turbush | 40/312 |
| 2,112,550 | 3/1938 | Amsden | 40/312 |
| 2,162,915 | 6/1939 | Graben | 40/312 |
| 2,328,806 | 9/1943 | Hoofer | 40/311 |
| 2,363,418 | 11/1944 | Hosmer | 40/311 |
| 2,632,269 | 3/1953 | Sanders | 40/594 |
| 3,166,233 | 1/1965 | Cutler et al. | 206/606 |
| 3,380,181 | 4/1968 | Karel | 40/312 |
| 3,600,812 | 8/1971 | Cromoga | 40/594 |
| 3,681,160 | 8/1972 | Richie et al. | 40/312 |
| 3,809,227 | 5/1974 | Begemann | 206/459 |

*Primary Examiner*—Stephen Marcus
*Assistant Examiner*—Gary E. Elkins
*Attorney, Agent, or Firm*—Pennie & Edmonds

[57] ABSTRACT

A foldable display tab is disclosed which is readily adhered to the removable top section of the plastic overwrap of a package. The display is folded flat for shipment, is movable to an upstanding position for point-of-sale display and is easily removable by the consumer after sale by tearing off the top portion of the overwrap without affecting the integrity of the remaining overwrap. The display tab carries a commerical message highly visible when standing up.

4 Claims, 2 Drawing Sheets

DISPLAY TAB FOR OVERWRAPPED PACKAGE

This is a continuation of application Ser. No. 56,207, filed June 1, 1987, now abandoned.

BACKGROUND OF THE INVENTION

Numerous packages have been proposed having coupons formed as part of a package for removal after purchase by cutting or tearing (see U.S. Pat. Nos. 911,884; 3,183,614; and Canadian Patent No. 664,202.

Commerical materials have been adhered to over-Wrapped ciqarette packs but removal of such materials has not been satisfactory.

SUMMARY OF THE INVENTION

Broadly, the present invention comprises a foldable display tab readily adhered to the removable top section of the plastic overwrap of a package. The display is folded flat for shipment, is movable to an upstanding position for point-of-sale display and is easily removable by the consumer after sale by tearing off the top portion of the overwrap without effecting the integrity of the remaining overwrap or other portion of the package.

It is a feature of the display tab that it carries a commercial message highly visible when standing up and the tab can be folded down against the package when packed in a larger container for shipment and storage.

It is also a feature that upon removal of the display tab in the normal course of opening the package leaves a package with a normal appearance without evidence that the tab was at one time on the package.

DESCRIPTION OF THE PREFERRED EMBODIMENT

Figure 2:
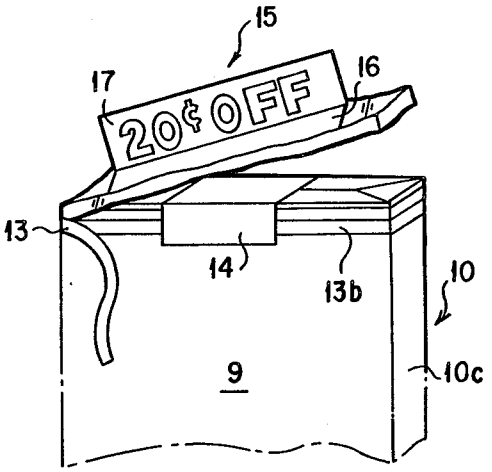
FIG. 2 is a perspective view of a part of the pack with the top portion of the overwrap, with attached display tab, partially removed.
Figure 1:
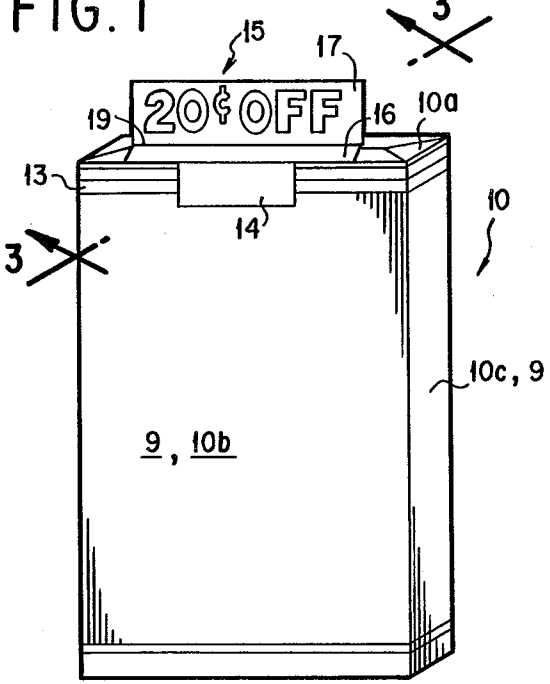
FIG. 1 is a perspective view of the overwrapped pack of the invention having the display tab thereon.
Figure 3:
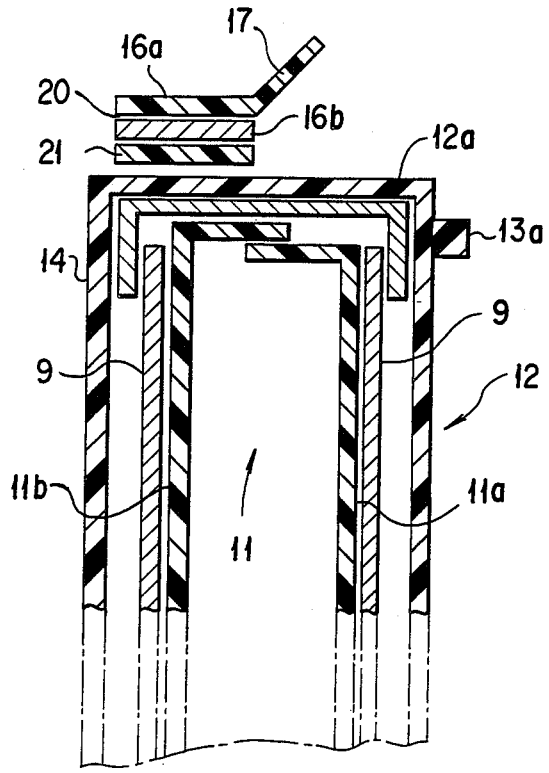
FIG. 3 is an exploded partial side sectional elevational view along line 3—3 of FIG. 1.

Turning to FIGS. 1–3, cigarette pack 10 with top 10*a*, sides 10*b* and ends 10*c* includes a folded foil laminated paper cigarette body 11, sleeve 9 surrounding body 11, and a plastic overwrap 12 in turn surrounding sleeve 9 and body 11 to protect against the exit or entrance of air and moisture. Elongated tear strip 13 assists in the ready removal of the top portion 12*a* of the plastic overwrap 12. Overwrap 12 is preferably a cellophane but may be any suitable wrapping material. Also shown is tobacco tax stamp 14.

Indicia-carrying display tab 15 has a base portion 16 and an upstanding portion 17 formed by bending tab 15 along crease or score line 19. Tab 15 carries the commercial message "20¢ off" and may carry other point-of-sale information or copy such as special sale; price; a product feature, etc. Tab 15 is made of paper stock and, alternatively, may be made of cellulose, treated cloth or other printable laminate material which permits the upstanding portion 17 to be held in a non-horizontal position for a period of time upon formation of crease line 19. Tab 15 is preferably 1⅝ inches in the horizontal direction as positioned on pack 10 and one (1) inch in the other direction with the score or crease line 19, 13/32 inch from the upper edge of upstanding portion

17. Tab 15 is constructed of two laminates; a 50 pound stock paper laminate and an 8 point tagboard laminate which laminate carries the commercial message.

Base portion 16 has on it a layer of adhesive 21 which adhesive is firmly adhered to the bottom of base portion 16 and to the top 12*a* of the overwrap 12. The adhesive is a permanent acrylic Fasson's pattern coat stock (S-246). Base portion 16 has sufficient thickness and laminate separation characteristics such that it will part or separate upon a sufficient pulling force being applied to upstanding portion 17 thus forming an upper layer 16*a* attached through crease line 19 to portion 17 and lower layer 16*b* attached to adhesive 21. The part line 20 (shown as a space in exploded FIG. 3 view) is between upper layer 16*b* and lower layer 16*b*. Other adhesives can be used that provide a strong bond between portions 16, 16*a* and top overwrap l2*a*. The amount and penetration of the adhesive into tab 15 will effect the location of the part line 20. Display tab 15 is not intended to be removable from pack 10 except by removal of top 12*a* of overwrap 12 in the normal course of opening pack 10 (see FIG. 2). If partial or complete removal of tab 15 is accomplished by pulling on the tab 15 itself, tab 15 will part along parting or separation line 20 leaving lower layer 16*b* adhered to the overwrap top 12*a* which lower layer 16*b* would be unsightly.

Turning to FIGS. 1 and 3, display tab 15 includes upstanding portion 17 shown at about a 45° angle to its base 16. When pack 10 is packaged in a carton (not shown) upstanding portion 17 is folded and pressed down against overwrap 12. Upon opening the carton, upstanding portion 17 will spring up a distance such as shown in FIG. 3. If a more erect position is desired, the upstanding portion 17 may be bent over and crease 19 re-pressed. Also shown in FIG. 3 are tax stamp 14, overlapping foil wrap panels 11*a*, 11*b* and tear strip end 13*a*. In alignment with tearing strip 13 is a decorative line 13*b* printed on sleeve 9.

In operation, tab 15 is adhered to the top portion 12*a* of plastic overwrap 12 of pack 10 by applying adhesive 21 to pack top 12*a* and then placing base portion 16 against adhesive 21. Crease 19 which is preferably preformed to urge upstanding portion 17 into a position away from the pack overwrap top 12*a* so that the indicia on it are readily observable. When tab 15 is adhered before the packs 10 are placed in a carton portions 17 are flattened against the pack overwrap tops 12*a* as the carton is closed and sealed. When the carton is opened, upstanding portion 17 will rise and move away from the pack tops 12*a*. By manipulating the upstanding portion 17 with the hand, it can be readily caused to remain in a more upright or vertical position, if desired, for display purposes in stores or other point-of-sale locations.

After the consumer buys the pack 10, tab 15 will, in normal use, be removed by the consumer's pulling tear strip 13 to remove overwrap top 12*a* with tab 15 attached. Such removal does not damage the remainder of the plastic overwrap 12. The consumer is able to remove tab 15, which has on it a commercial statement or message, and thus avoid the presence of such commercial message during the period of use of the pack, whether carried on the person, or used as a cigarette dispenser in the home or office.

Efforts by retailers or others to remove tab 15 prior to the opening of pack 10 by the consumer are discouraged by the fact that such removal (1) leaves an unsightly layer 16*b* adhered through adhesive 21 to the pack overwrap top 12*a* or (2) causes a rip or tear in the overwrap 12, either of which alternatives reduces the pack's saleability by the retailer.

I claim:

1. In a package having an overwrap and removable top portion of such overwrap, the improvement comprising (a) an indicia-carrying tab element having (i) a base panel capable of parting under tension and;

(ii) an upstanding panel (b) a layer of adhesive between the base panel and removable portion of the film overwrap which adhesive adheres permanently to the base panel and adheres permanently to the removable portion of overwrap whereby the indicia tab element is readily adhered to and removable from the package along with removal of the removable portion of the overwrap.

2. The improvement of claim 1 in which upstanding panel is attached to the base panel along a crease line.

3. The improvement of claim 1 in which the base panel of the tab element is made of a material that parts upon sufficient tension being placed n the upstanding panel leaving a layer portion of the base panel attached to the package.

4. The improvement of claim 1 in which the package is a cigarette pack; the overwrap is a transparent plastic and the removable portion is a top portion removed by pulling on a tear strip.

* * * * *